US010012941B2

(12) United States Patent
Masui et al.

(10) Patent No.: US 10,012,941 B2
(45) Date of Patent: Jul. 3, 2018

(54) IMAGE PROCESSING APPARATUS AND IMAGE PROCESSING ADJUSTMENT METHOD

(71) Applicant: Oki Data Corporation, Tokyo (JP)

(72) Inventors: Naoki Masui, Tokyo (JP); Hideo Suto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/297,202

(22) Filed: Oct. 19, 2016

(65) Prior Publication Data

US 2017/0123362 A1 May 4, 2017

(30) Foreign Application Priority Data

Oct. 30, 2015 (JP) ..... 2015-213955

(51) Int. Cl.
*G03G 15/00* (2006.01)

(52) U.S. Cl.
CPC ..... *G03G 15/556* (2013.01)

(58) Field of Classification Search
CPC combination set(s) only.
See application file for complete search history.

(56) References Cited

U.S. PATENT DOCUMENTS 8,649,696 B2 * 2/2014 Takemura ..... G03G 15/6585 399/39
2008/0165387 A1 * 7/2008 Wu ..... G03G 21/043 358/3.28
2009/0268216 A1 * 10/2009 Iinuma ..... G03G 15/0131 358/1.4
2012/0002994 A1 * 1/2012 Moroney ..... G03G 15/5016 399/72
2012/0051811 A1 * 3/2012 Hosoi ..... G03G 15/2021 399/341
2013/0114980 A1 * 5/2013 Veregin ..... G03G 15/0189 399/258

FOREIGN PATENT DOCUMENTS

JP 2012-083665 A 4/2012

* cited by examiner

*Primary Examiner* — Clayton E LaBalle
*Assistant Examiner* — Jas Sanghera
(74) *Attorney, Agent, or Firm* — Metrolexis Law Group PLLC

(57) ABSTRACT

An image processing apparatus includes a printer device and an adjustment part. The printer device includes: an image formation unit that forms a toner image on a medium with toners including a regular toner and a special toner; and a fixation unit that performs a predetermined number of fixation operations of fusing the toner image on the medium. The adjustment part causes the printer device to print a first sample image using the special toner at various density levels, and receives a first setting for the density level of the special toner based on the printed first sample image. The printer device forms the toner image on the medium based on the first setting received, and fixes the toner image on the medium.

13 Claims, 9 Drawing Sheets

Fig. 4

200

| | ITEM | VALUE |
|---|---|---|
| 201 | USER NAME | Yamada |
| 202 | USER DEPARTMENT | DEVELOPMENT DPT. |
| 203 | YEARS OF SERVICE | 11 |
| 204 | POSITION | SECTION CHIEF |
| 205 | TYPE OF JOB SUBMITTED | SEND EMAIL |
| 206 | SET VALUE (DESTINATION EMAIL ADDRESS) | AAA@bbb.ccc |
| 207 | SET VALUE (FILE FORMAT) | PDF |
| 208 | TIME OF JOB SUBMISSION | 15:03 |

IMAGE PROCESSING APPARATUS AND IMAGE PROCESSING ADJUSTMENT METHOD

CROSS REFERENCE TO RELATED APPLICATIONS

This application claims priority based on 35 USC 119 from prior Japanese Patent Application No. 2015-213955 filed on Oct. 30, 2015, entitled "IMAGE PROCESSING APPARATUS AND IMAGE PROCESSING ADJUSTMENT METHOD", the entire contents of which are incorporated herein by reference.

BACKGROUND OF THE INVENTION

1. Field of the Invention

The disclosure relates to an image processing apparatus that uses a special toner and an image processing adjustment method for the same.

2. Description of Related Art

In forming a printed product by using a transparent toner, which is a special toner, a conventional image processing apparatus first measures the surface roughness of a medium, determines the amount of transparent toner to be applied according to the surface roughness, and then applies the determined amount of transparent toner to the medium (see, for example, Japanese Patent Application Publication No. 2012-83665). This is because, even if the same amount of transparent toner is applied to a medium, the gloss level of the surface of the printed product varies depending on the surface roughness of the medium.

SUMMARY OF THE INVENTION

Such a conventional technique of determining the amount of transparent toner (special toner) according to the surface roughness of a medium, however, may fail to provide a printed product with a print result as desired by a user. In some cases the desired result may depend on the user's intended use of the printed product, such as the need to add a security feature or a design object, or on the surface-finishing condition of the printed product, such as whether the printed product has a surface coating or not.

An object of an embodiment of the invention is to enable printing using a special toner to provide a print result as desired by a user.

A first aspect of the invention is an image processing apparatus that includes: a printer device including an image formation unit that forms a toner image on a medium by using a regular toner and a special toner, and a fixation unit that performs a predetermined number of fixation operations of fixing the toner image on the medium; and an adjustment unit that causes the printer device to print a first sample image using the special toner at various density levels, and receives a first setting for the density level of the special toner based on the printed first sample image. The printer device forms the toner image on the medium based on the first setting received, and fixes (fuses) the toner image on the medium.

A second aspect of the invention is an image processing apparatus that includes: a printer device including an image formation unit that forms, on a medium, a toner image including a regular toner and a special toner, and a fixation unit that performs a predetermined number of fixation operations of fusing the toner image on the medium; and an adjustment part that causes the printer device to print two or more same sample images at respectively different fixation temperatures, thereby acquires printed products on which the sample images are respectively printed, and receives a setting for a fixation temperature based on the plurality of printed products. The printer device performs an image formation operation of forming the toner image on the medium, and performs a fixation operation of fusing the toner image on the medium based on the setting received.

A third aspect of the invention is an image processing apparatus that includes: a printer device including an image formation unit that forms a toner image on a medium with toners including a regular toner and a special toner, and a fixation unit that performs a predetermined number of fixation operations of fixing the toner image on the medium; and an adjustment part that causes the printer device to print a first sample image using the special toner while varying a first printing condition, receives a first setting based on the first sample image thus printed, causes the printer device to print a second sample image using the special toner while varying a second printing condition, and receives a second setting based on the second sample image thus printed. The printer device makes a setting for a density level of the special toner in the toner image based on the first setting received, forms the toner image with the special toner at the density level thus set, makes a setting for the fixation operation of the fixation unit based on the second setting, and fixes the toner image on the medium by performing the fixation operation thus set.

The above aspects of the invention can enable printing using a special toner to provide a print result as desired by a user.

BRIEF DESCRIPTION OF THE DRAWINGS

FIG. 4 is a diagram illustrating job submission information according to the first embodiment.

DETAILED DESCRIPTION OF EMBODIMENTS

Figure 1:
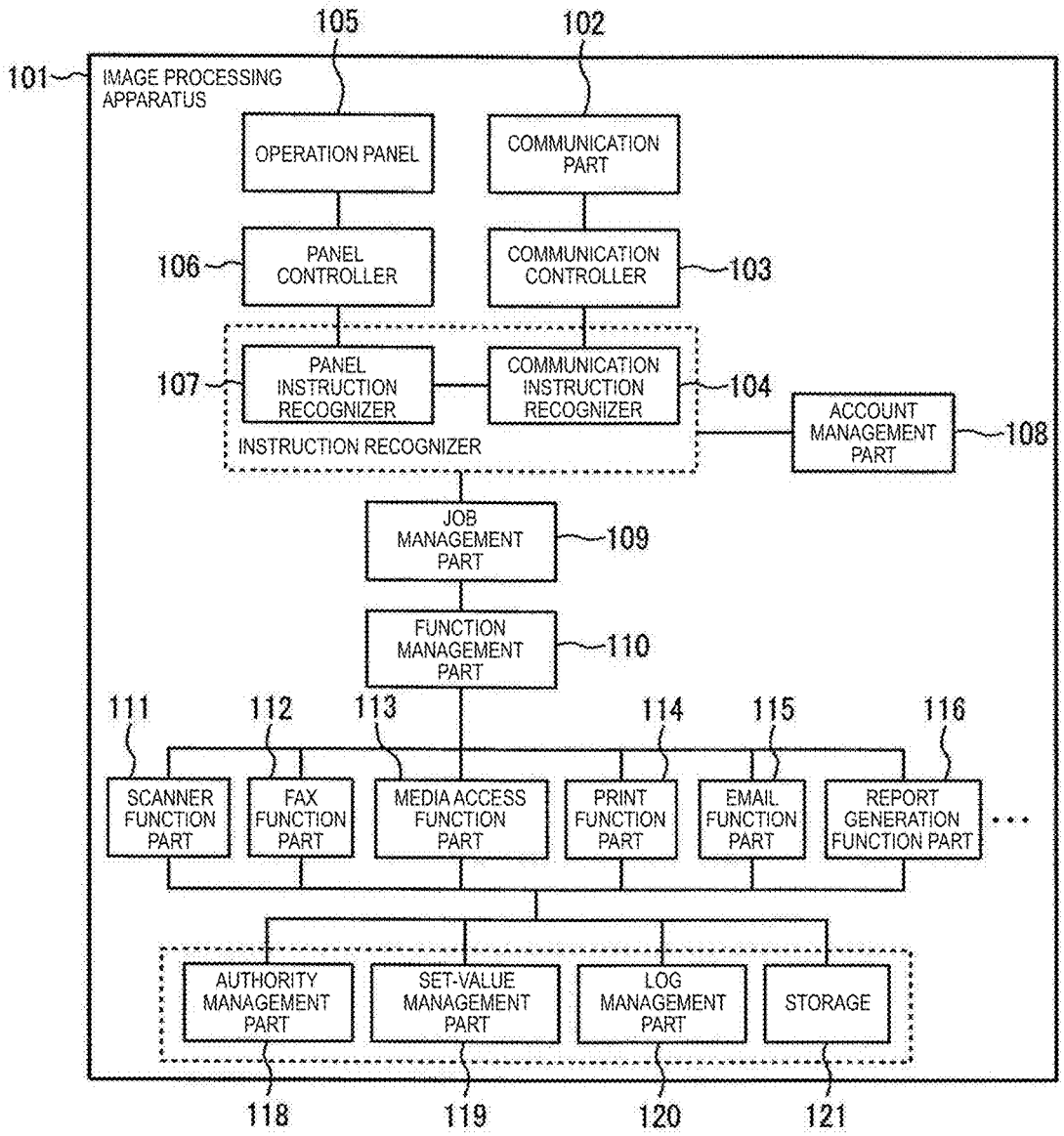
FIG. 1 is a block diagram illustrating the configuration of an image processing apparatus according to a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Embodiments of an image processing apparatus and an image processing adjustment method of the invention are described below with reference to the drawings.

[Embodiment 1]

FIG. 1 is a block diagram showing the configuration of an image processing apparatus according to a first embodiment.

In FIG. 1, image processing apparatus 101 is, for example, a multi-function peripheral (MFP). Image processing apparatus 101 includes printer function part 114 that performs printing using toners of cyan, magenta, yellow, and black (CMYK) (referred to as "regular toners" hereinbelow) and ultraviolet (UV) toners of red, green, and blue (RGB) as special toners. The UV toners fluoresce by reacting to ultraviolet light, and are transparent under visible light.

Figure 2:
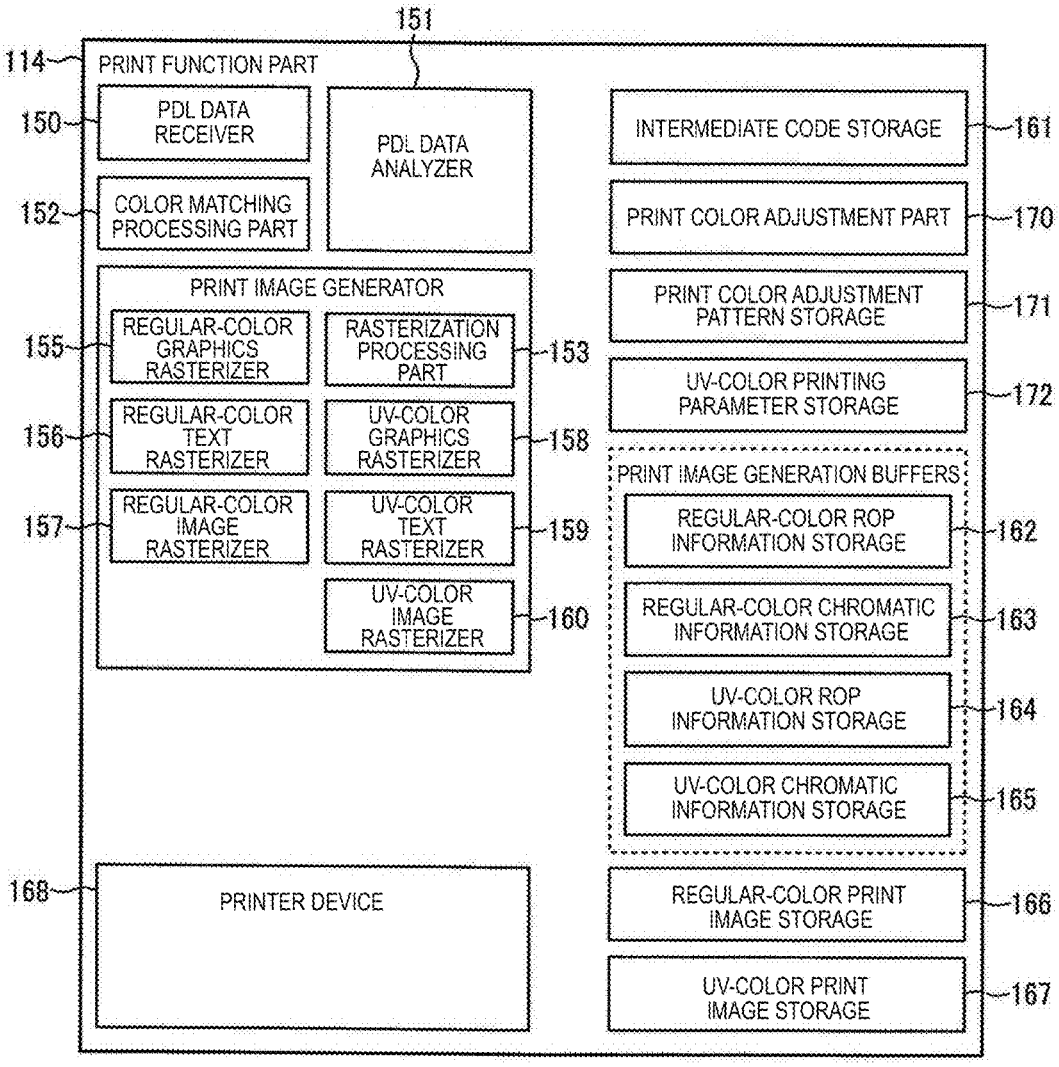
FIG. 2 is a block diagram illustrating the configuration of a print function part according to the first embodiment.

As shown in FIG. 2, printer function part 114 of image processing apparatus 101 has printer device 168 that performs printing on a sheet (a print medium).

Figure 3:
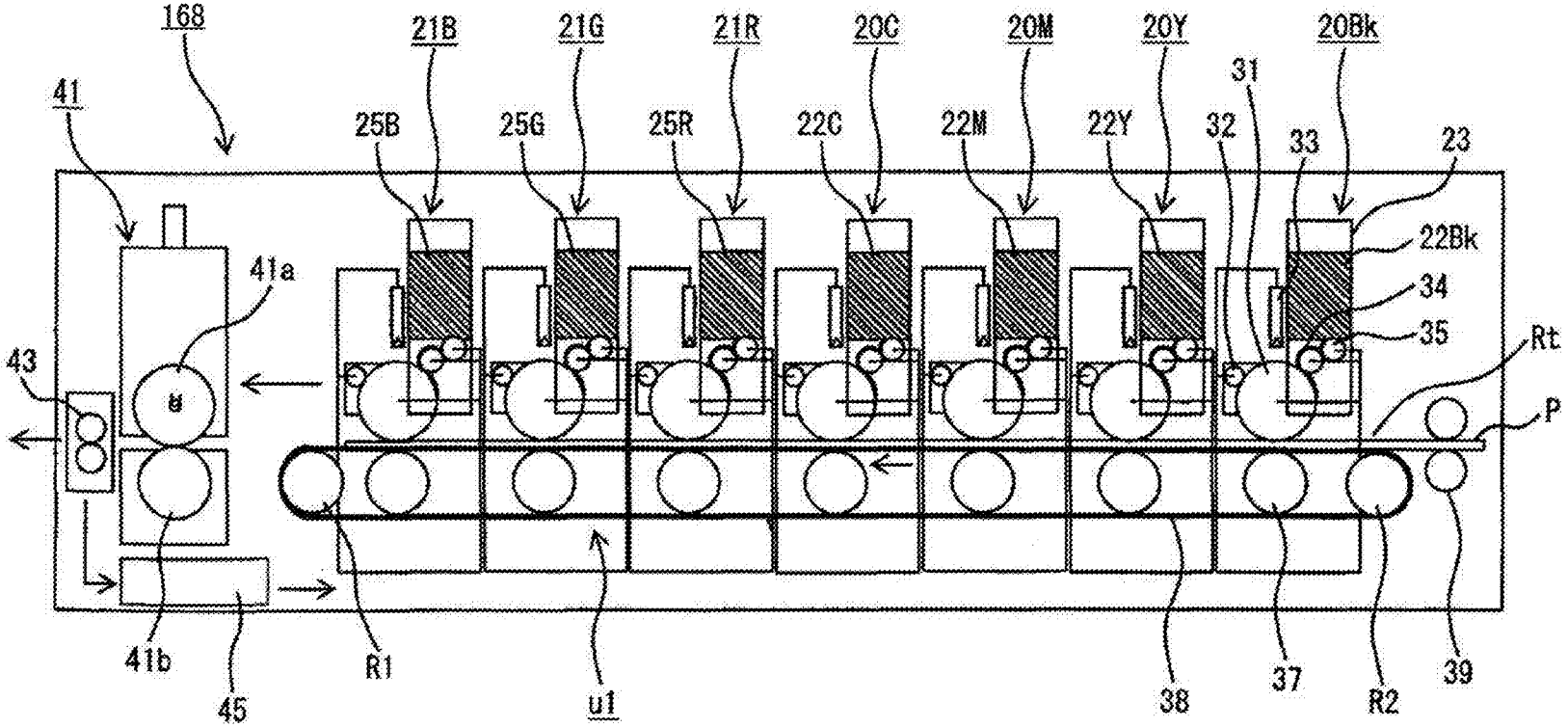
FIG. 3 is a diagram illustrating the structure of a printer device of the print function part of the image processing apparatus according to the first embodiment.

The printer device 168 includes, as shown in FIG. 3, sheet feeder 39 that feeds a sheet from a sheet cassette (not shown) housing sheets (print media), image formation unit 20 that forms a toner image containing the regular toners of CMYK and the UV toners of RGB and transfers the toner image to the sheet fed by sheet feeder 39, fixation unit 41 that applies heat and pressure and thereby fixes (fuses) the toner image transferred onto the sheet by image formation unit 20, and discharger 43 that discharges the sheet having the image thereon out of printer device 168.

Image processing apparatus 101 has communication part 102, communication controller 103, communication instruction recognizer 104, operation panel 105, panel controller 106, panel instruction recognizer 107, account management part 108, job management part 109, function management part 110, scanner function part 111, fax function part 112, media access function part 113, printer function part 114, email function part 115, report generation function part 116, authority management part 118, set-value management part 119, log management part 120, and storage 121.

Communication part 102 has a communication protocol, and performs communications, such as transmission and reception of information, with an external device by following the protocol. In image processing apparatus 101, communication part 102 serves as a contact with an external device, and also does operation panel 105. In information transfer, communication part 102 does not perform communication having its own content voluntarily, but only as instructed by an upper layer.

Communication part 102 performs local communications (e.g., a universal serial bus (USB) or IEEE1394), as well as global communications (e.g., a network (such as a LAN or a WAN) or facsimile (called "fax" hereinbelow)). The communication part 102 is mainly hardware, with software that includes part of microprograms. The microprograms are dedicated programs downloaded to the hardware to perform, for the hardware, part of the processing to be implemented by the hardware.

Communication controller 103 is software that causes the communication part 102 to operate. The roles of communication controller 103 is to transfer information received by communication part 102 to software of an upper layer within the image processing apparatus 101 and to control communication part 102 to transmit information received from the upper-layer software to an external device.

Communication instruction recognizer 104 (an instruction recognizer) is software of an upper layer of communication part 102. Communication instruction recognizer 104 interprets information received by and transferred from communication part 102, determines the processing requested by a command based on a result of the interpretation, and executes the processing if it is simple. In the interpretation of information received by and transferred from communication part 102, communication instruction recognizer 104 finds a command in the received information, analyzes the command, and thereby discovers what the command is requesting. The simple processing is, for example, viewing or changing set values.

When determining based on the result of the interpretation of the received information that the processing requested by the command is complicated, communication instruction recognizer 104 transfers the received information to job management part 109, asking job management part 109 to process the information instead. The complicated processing is, for example, printing.

Depending on the command processed, communication instruction recognizer 104 requests an external device (an upper-layer device) for authentication information in order to check the authority of the requester. Upon receipt of authentication information from the upper-layer device, communication instruction recognizer 104 performs an authentication of the requester using the authentication information, and if the requester is authenticated, requests job management part 109 to process the command with a user identifier as an argument, the user identifier being in the authentication information transmitted from the upper-layer device. Job management part 109 can thereby identify the requesting user and determine whether the requested processing is executable or not. Whether to perform authentication of the requester is controlled by an authentication set value (ON or OFF) retained by set-value management part 119: authentication is performed when the authentication set value is ON, and not performed when the authentication set value is OFF.

Operation panel 105 is an input/output device directly connected to the inside of the image processing apparatus 101 via an internal bus interface. The output device is a display such as a liquid crystal display (LCD) panel or light emitting diodes (LEDs). There are LCD panels of various sizes, but as an LCD panel for image processing apparatus 101, a VGA (640×480 dots) LCD panel or a smaller panel may be used. As the LED, multiple LEDs assigned with respective meanings are mounted, and each is turned on or off to indicate its meaning. The input device comprises operation buttons and a touch panel, or the like provided on the panel. Operation panel 105 is mainly hardware, and software that includes part of microprograms.

Panel controller 106 is software that controls operation panel 105. Panel controller 106 switches the display on operation panel 105 in response to a user operation received by operation panel 105 or an event occurring within image processing apparatus 101. A user operation includes a screen operation, such as moving a screen displayed on the output device and changing the display, and an input operation, such as selecting or entering a value.

Panel controller 106 performs processing for the screen operation, and also asks panel instruction recognizer 107 to perform processing for the input operation. In addition, according to an event occurring in image processing apparatus 101, panel controller 106 displays a status screen showing the status of image processing apparatus 101. In displaying a screen on operation panel 105, panel controller 106 transforms information into bitmap screen data and transfers the bitmap screen data to operation panel 105.

Panel instruction recognizer 107 (constituting the instruction recognizer) receives, as an input, notification of user operation information via operation panel 105 and panel controller 106, and recognizes the content of the user instruction. Panel instruction recognizer 107 displays a menu of items indicating services and functions provided by image processing apparatus 101, and prompts the user to select an item from the displayed menu. The services and functions include COPY (to make a copy), Scan To Email (to send an electronic mail (email) of a scanned image), Scan To Fax (to send a fax of a scanned image), and the like, as well as changing set values and the like.

Panel instruction recognizer 107 processes the recognized user instruction directly if the user instruction involves a simple processing (such as viewing or changing set values), or panel instruction recognizer 107 requests job management part 109 to process the user instruction if the user instruction involves a complicated processing (i.e., a service or function that involves printing, scanning, or the like (referred to as a job hereinbelow)), because such a user instruction requires special processing as a job.

The user operation information entered contains not only information on the type of a selected job, but also additional information necessary for execution of the job. Examples of the additional information necessary for execution of a job include a fax number if the job involves sending a fax (e.g., Scan To Fax), a destination email address if the job involves sending an email (e.g., Scan To Email), resolution, density level, one- or two-sided printing, the number of copies, and the like if the job involves printing (e.g., COPY). Herein, the additional information necessary for execution of a job is called "job submission information", and is described in detail later.

Depending on the job to be processed, panel instruction recognizer 107 requests authentication information from the user via operation panel 105 and panel controller 106 to check if the requester has authority. In receipt of authentication information from the user, panel instruction recognizer 107 performs a user authentication using the authentication information. Then, if the user is authenticated, panel instruction recognizer 107 requests job management part 109 to perform processing for the job with a user identifier as an argument, the user identifier being in the authentication information entered by the user. Job management part 109 can thereby identify the user and determine whether processing for the requested job is executable. Whether to perform authentication of the requester is controlled by an authentication set value (ON or OFF) retained by set-value management part 119: authentication is performed when the authentication set value is ON, and not performed when the authentication set value is OFF.

Job management part 109 receives a user-requested job via communication instruction recognizer 104 or panel instruction recognizer 107, selects a processing part for executing the job received, and instructs the processing part to execute the job. In addition, job management part 109 monitors the status of the job being executed by the processing part and determines whether the processing is completed. Job management part 109 also receives and processes an instruction for an operation made with respect to the job.

Upon receipt of a job, job management part 109 performs authority verification to check whether a user requesting the job is authorized to execute the job. When determining as a result of the authority verification that the job is executable, job management part 109 attaches the verified user identifier to the job as the owner of the job. When a job is inputted from automatically-activated internal processing such as local printing, the job is executed without the authority verification processing.

Job management part 109 monitors the status of the job being executed by the processing part, such as "waiting to be started", "being executed", or "having been started but abnormally ended". Job management part 109 also monitors whether the job is normally ended or abnormally ended, and in a case of the abnormal end, monitors the cause thereof.

In addition, job management part 109 manages job-related information, and responds to an inquiry about a job. Upon receipt of an instruction to, for example, start, pause, cancel, or resume a job, job management part 109 starts, pauses, cancels, or resumes the job according to the instruction.

Upon receipt of an inquiry or an instruction as to a job, job management part 109 checks a user identifier attached to the job. Then, for example, job management part 109 responds to the inquiry or executes the instruction if the user who has made the inquiry or command is the owner of the job, and rejects to respond to the inquiry or execute the instruction if the user is not the owner of the job.

Function management part 110 manages the function parts in the image processing apparatus 101. In accordance with an instruction from job management part 109, function management part 110 assigns a function part to a job to cause that function part to process the job. In a case of Scan To Email for example, job management part 109 handles the job as the service requested by a user, i.e., Scan To Email, whereas function management part 110 assigns jobs constituting the requested job, i.e., scan processing and email processing, to corresponding function parts, and manages them individually. Such assignment of job components to corresponding function parts enables various combinations of the function parts and therefore execution of various jobs. This can reduce the number of function parts to be held in and managed by image processing apparatus 101, and therefore facilitate the overall control.

Image processing apparatus 101 of the embodiment has scanner function part 111, fax function part 112, media access function part 113, printer function part 114, email function part 115, and report generation function part 116.

The scanner function part 111 performs a control of generating image data of an original by driving a scanner unit equipped with an image reading sensor to scan the original. Scanner function part 111 performs an operation specializing in scanning. Thus, scanner function part 111 does not change its operation depending on a function used in combination therewith. Scanner function part 111 stores information on its operation history in log management part 120.

Fax function part 112 controls fax reception and fax transmission. Fax function part 112 stores or transfers image data received by fax in or to a storage area provided by job management part 109, or sends a fax of image data stored in the storage area provided by job management part 109. Fax function part 112 performs an operation specializing in fax transmission and reception. Thus, fax function part 112 does not change its operation depending on a function used in combination therewith. Fax function part 112 stores information on its operation history in log management part 120.

Media access function part 113 has a slot which allows a portable storage medium to be attached to image processing apparatus 101, and handles data in the storage medium attached. Media access function part 113 performs the processing of reading data from the storage medium and passing the data to a post-processing part, and processing of writing data passed from a pre-processing part into the storage medium. The portable storage medium is a storage medium which is not always attached to image processing apparatus 101, such as a USB memory or a memory card, and is owned by a user to carry data.

Media access function part 113 performs an operation specializing in data access to storage media. Thus, media access function part 113 does not change its operation depending on a function used in combination therewith. Media access function part 113 stores information on its operation history in log management part 120.

Printer function part 114 prints data supplied by function management part 110 by controlling the printing operation, by which an image is formed on a record medium. Printer function part 114 forms a toner image on a recording medium according to data supplied by function management part 110 in a printing step for example, and discharges the recording medium on which the toner image is fused or fixed, to a discharge stacker. Printer function part 114 performs an operation specializing in printing. Thus, printer function part 114 does not change its operation depending on a function used in combination therewith. Printer function part 114 stores information on its operation history in log management part 120.

Now, a description is given of printer function part 114 with reference to FIG. 3 which is a block diagram illustrating the configuration of printer function part 114 of the first embodiment.

In FIG. 3, printer function part 114 includes PDL data receiver 150, PDL data analyzer 151, color matching processing part 152, rasterization processing part 153, regular-color graphics rasterizer 155, regular-color text rasterizer 156, regular-color image rasterizer 157, UV-color graphics rasterizer 158, UV-color text rasterizer 159, UV-color image rasterizer 160, intermediate-code storage 161, regular-color ROP (raster operation) information storage 162, regular-color chromatic information storage 163, UV-color ROP information storage 164, UV-color chromatic information storage 165, regular-color print image storage 166, UV-color print image storage 167, printer device 168, print color adjustment part 170, print color adjustment pattern storage 171, and UV-color print parameter storage 172.

PDL data receiver 150 receives, from function management part 110 shown in FIG. 1, data to be processed by printer function part 114, the data being written in a page description language (PDL) (called "PDL data" hereinbelow).

PDL data analyzer 151 analyzes the PDL data received by PDL data receiver 150 and generates a display list according to instructions in the PDL data. A display list is a data format representing an intermediate state between PDL interpretation and raster image generation, and is thus called "intermediate data" in the embodiment.

When determining from the result of the PDL data analysis that the PDL data contains data to be printed with a UV toner, PDL data analyzer 151 instructs that the print settings information stored in UV-color print parameter storage 172, be transmitted to printer device 168.

Color matching processing part 152 transforms the standard color representations described in the PDL in accordance with the capability of a device that prints the data, so that a printing result may not be affected by the differences in the color representation capabilities of individual devices.

Intermediate-code storage 161 is a buffer management part having a storage area for storing the intermediate data generated by PDL data analyzer 151.

Rasterization processing part 153 constitutes a print image generator and generates print image data based on the intermediate data generated by PDL data analyzer 151. Rasterization processing part 153 generates the print image data by asking for processing by regular-color graphics rasterizer 155, regular-color text rasterizer 156, regular-color image rasterizer 157, UV-color graphics rasterizer 158, UV-color text rasterizer 159, or UV-color image rasterizer 160. Rasterization processing part 153 makes a final determination as to whether the requested part has succeeded or failed the generation of the print image data.

Regular-color graphics rasterizer 155 generates raster data according to a graphics rasterization instruction for a regular color (regular toner color) written in the PDL. Regular-color graphics rasterizer 155 stores unfinished data (raster data and regular-color-specifying information) in regular-color ROP information storage 162 and regular-color chromatic information storage 163, respectively. Then, regular-color graphics rasterizer 155 stores finished raster data in regular-color print image storage 166.

Regular-color text rasterizer 156 generates raster data according to a text rasterization instruction for a regular color written in the PDL. Regular-color text rasterizer 156 stores unfinished data (raster data and regular-color-specifying information) in regular-color ROP information storage 162 and regular-color chromatic information storage 163, respectively. Then, regular-color text rasterizer 156 stores finished raster data in regular-color print image storage 166.

Regular-color image rasterizer 157 generates raster data according to an image rasterization instruction for a regular color written in the PDL. Regular-color image rasterizer 157 stores unfinished data (raster data and regular-color-specifying information) in regular-color ROP information storage 162 and regular-color chromatic information storage 163, respectively. Then, regular-color image rasterizer 157 stores finished raster data in regular-color print image storage 166.

UV-color graphics rasterizer 158 generates raster data according to a graphics rasterization instruction for a UV color (UV toner color) written in the PDL. UV-color graphics rasterizer 158 stores unfinished data (raster data and UV-color-specifying information) in UV-color ROP information storage 164 and UV-color chromatic information storage 165, respectively. Then, UV-color graphics rasterizer 158 stores finished raster data in UV-color print image storage 167.

UV-color text rasterizer 159 generates raster data according to a text rasterization instruction for a UV color written in the PDL. UV-color text rasterizer 159 stores unfinished data (raster data and UV-color-specifying information) in UV-color ROP information storage 164 and UV-color chromatic information storage 165, respectively. Then, UV-color text rasterizer 159 stores finished raster data in UV-color print image storage 167.

UV-color image rasterizer 160 generates raster data according to an image rasterization instruction for a UV color written in the PDL. UV-color image rasterizer 160 stores unfinished data (raster data and UV-color-specifying information) in UV-color ROP information storage 164 and UV-color chromatic information storage 165, respectively. Then, UV-color image rasterizer 160 stores finished raster data in UV-color print image storage 167.

Printer device 168 receives the raster data stored in regular-color print image storage 166 and the raster data stored in UV-color print image storage 167 as print image data, and prints this print image data based on information stored in UV-color print parameter storage 172, namely, the density of each UV toner color, the fixation temperature (fusing temperature), and the number of fixation operations (fusing operations).

Printer device 168 performs printing in the following manner. The sheet feeder feeds a print medium from the sheet cassette, the image formation units form regular-color (CMYK) toner images and UV-color (RGB) toner images on the print medium, the fixation unit fixes the transferred toners on the print medium by applying predetermined heat and pressure, and the discharger discharges the print medium out of printer device 168.

During the printing, printer device 168 controls the fixation temperature by controlling the power supplied to a heater of the fixation unit, and controls the number of fixation operations by controlling the number of times a print medium passes through the fixation unit. Conveyance paths for conveying print media include an annular reconveyance path along which a print medium is reconveyed to the fixation unit. Thus, the print medium can be reconveyed to, and pass through, the fixation unit a desired number of times when its conveyance path is switched by a conveyance-path switcher the desired number of times.

In other words, printer device 168 performs printing by forming regular and UV toner images on a medium at predetermined density levels, and fusing the toner images a predetermined number of times using a predetermined fixation temperature.

Print color adjuster 170 (an adjuster) controls the user settings of the print density of each UV toner color, the fixation temperature, and the number of fixation operations. Print color adjustment part 170 receives an instruction for changing the print settings for the image data containing a UV color from operation panel 105, and sends printer device 168 instructions to print one first sample printed product, multiple second sample printed products, and multiple third sample printed products. Printed on the first sample printed product is a first sample image formed of UV color images at different density levels for each color of UV toners. Printed on the multiple second-sample printed products are second sample images which are printed using different fixation temperatures. Printed on the multiple third-sample printed products are third sample images which are printed using different numbers of fixation operations.

Then, print color adjuster 170 receives a first setting for the density levels of UV toners based on the one first-sample printed product, which is the first sample image printed by printer device 168 for each of the UV color toners while varying the density levels of the UV color toners. Print color adjustment part 170 also receives a second setting for the fixation temperature based on the multiple second-sample printed products, which are the second sample images printed by printer device 168 using different fixation temperatures. Print color adjustment part 170 also receives a third setting for the number of fixation operations based on the multiple third-sample printed products, which are the third sample images printed by printer device 168 using different numbers of fixation operations.

Printer device 168 performs printing by forming, on a medium, toner images containing UV toners at density levels set by print color adjustment part 170 and fusing (fixing) the toner images on the medium using the fixation temperature and the number of fixation operations set by print color adjustment part 170.

Print color adjustment pattern storage 171 (a format information storage) stores print pattern data including UV toners (the first sample image, the second sample image, and the third sample image). Print color adjustment pattern storage 171 sends the print pattern data to printer device 168 when instructed by print color adjustment part 170.

Specifically, print color adjustment pattern storage 171 stores first format information representing the format of the first sample image, second format information representing the format of the second sample image, and third format information representing the format of the third sample image.

Printer device 168 prints the first sample image, the second sample image, and the third sample image based respectively on the first format information, the second format information, and the third format information, which are stored in print color adjustment pattern storage 171.

UV-color print parameter storage 172 (a settings information storage) stores information set by print color adjustment part 170, namely, the print density level of each color of UV toners (the value of the first setting), the fixation temperature (the value of the second setting), and the number of fixation operations (the value of the third setting). When PDL data analyzer 151 determines as a result of data analysis that the PDL data contains data to be printed using UV toners, print color adjustment part 170 sends printer device 168 settings information set by the user's operation and stored in UV-color print parameter storage 172, namely, the print density level of each color of the UV toners, the fixation temperature, and the number of fixation operations.

The print setting information stored in UV-color print parameter storage 172, i.e., the printing density level of each color of UV toners, the fixation temperature, and the number of fixation operations, are set by the user based on the samples printed in the predetermined formats.

Printer device 168 prints the print image data based on the print density level of each UV toner, the fixation temperature, and the number of fixation operations stored in UV-color print parameter storage 172.

FIG. 1 is next referred to again.

Email function part 115 controls the transmission and reception of emails. Email function part 115 stores or transfers a received image in or to an area provided by job management part 109, and sending of an email of an image stored in the area provided by job management part 109. Email function part 115 performs an operation specializing in email transmission and reception. Thus, email function part 115 does not change its operation depending on a function used in combination therewith. Email function part 115 stores information on its operation history in log management part 120.

Report generation function part 116, upon receipt of the type of a local print to be outputted, generates data for the printing necessary for the local print. Report generation function part 116 reads various pieces of log data retained by log management part 120 and uses them as the data for the printing necessary for the local print. Since the log data thus read cannot be printed as they are, report generation function part 116 transforms the log data into a printable format and also rearranges the log data to facilitate visualization.

Account management part 108 retains the user information used for user authentication processing. The user authentication processing is performed by the instruction recognizer by checking authentication information A inputted from outside against authentication information B retained by account management part 108. Authentication information B retained by account management part 108 is a user identifier identifying a user, such as a user's name and a password, simple numbers, finger-print information, or iris information. Account management part 108 also retains information constituting "job submission information" in association with authentication information B. Details of the job submission information are given later.

Authority management part 118 manages the authority granted to a user who has passed the authentication processing by the instruction recognizer, i.e., whether a requested operation or the like is executable or not. Authority management part 118 receives the input of a user identifier identifying a user who has passed the authentication processing, and returns an authority stored in association with the inputted user identifier. In addition, to limit the usable amount of a consumable, authority management part 118 compares an upper limit value indicating the upper limit of the usable amount, with a counter value indicating the current remaining amount, and permits the user to continue the operation as long as the counter value does not exceed the upper limit value.

Set-value management part 119 manages set values for image processing apparatus 101 and enables a retrieval or change of the set values. Set-value management part 119 is accessible to all of the processing that use set values. Set-value management part 119 has a data persistence function, so as to keep retaining the data after the power is restored to image processing apparatus 101, for example.

In log management part 120, an operation history is stored as history data every time a job is executed. The history data stored in log management part 120 includes, for example, information on an execution result of a job, various counter values, and data processed during the execution of the job.

Storage 121 is a memory or the like that stores received data temporarily and stores commands transmitted and received. Storage 121 is accessible to all the processing. Storage 121 has a data persistence function, so as to keep retaining data after power is restored to image processing apparatus 101, for example.

For example, storage 121 stores control programs (software) for overall control of image processing apparatus 101 and information temporarily used for the control.

Image processing apparatus 101 thus configured includes a controlling unit or a processor such as a central processing unit (CPU) which controls the overall operation of image processing apparatus 101 based on the control programs stored in storage 121.

Details of the job submission information are now given.

The job submission information is information added to a job submitted to image processing apparatus 101 by a user. When submitting a job, a user enters, using operation panel 105 or the like, "the type of a job submitted" and "set values" for each type of job submitted, in addition to authentication information A such as a "user name" and "password".

The "user name" and "password" are input information required by the regular authentication processing. The instruction recognizer checks the entered "user name" and "password" against preregistered "user name" and "password", and thereby verifies whether the user is an authorized user of image processing apparatus 101.

If the user is an authorized user, information on the user is preregistered in account management part 108, the information being, e.g., the user's "department", "years of service", and "position". Necessary one or ones of these pieces of user information are added to the job submission information.

In addition, if image processing apparatus 101 is equipped with a clock (a real-time clock) or supports a network protocol that acquires the time from a time server, information on the time of job submission or the like is added to the job submission information.

Job submission information is thus a collection of various pieces of information about job submission.

For example, the job submission information contains "user name", "user department", "years of service", "position", "type of job submitted", "set values", and "time of job submission". The "type of job submitted" indicates the type of a job that the user wants image processing apparatus 101 to execute, and includes copying, printing, sending a fax, sending an email, and the like. The "set values" are settings information necessary for the execution of a job, the necessary information being, in a case of fax transmission, a destination fax number, image quality, and the like.

As an example, job submission information 200 shown in FIG. 4, contains user name 201, user department 202, years of service 203, position 204, type of job submitted 205, set value (destination email address) 206, set value (file format) 207, and time of job submission 208.

Example entries are "Yamada" for user name 201, "Development Dept." for user department 202, "11" for years of service 203, and "Section Chief" for position 204. User name 201 is entered by the user, and user department 202, years of service 203, and position 204 are added from the information registered in account management part 108.

Example entries are "Send Email" for type of job submitted 205, "AAA@bbb.ccc" for set value (destination email address) 206, "PDF" for set value (file format) 207, "15:03" for time of job submission 208. Type of job submitted 205, set value (destination email address) 206, and set value (file format) 207 are entered by the user submitting the job, and time of job submission 208 is added by image processing apparatus 101 using time information acquired from a clock or the like.

Operation of the foregoing configuration is described.

Figure 5A:
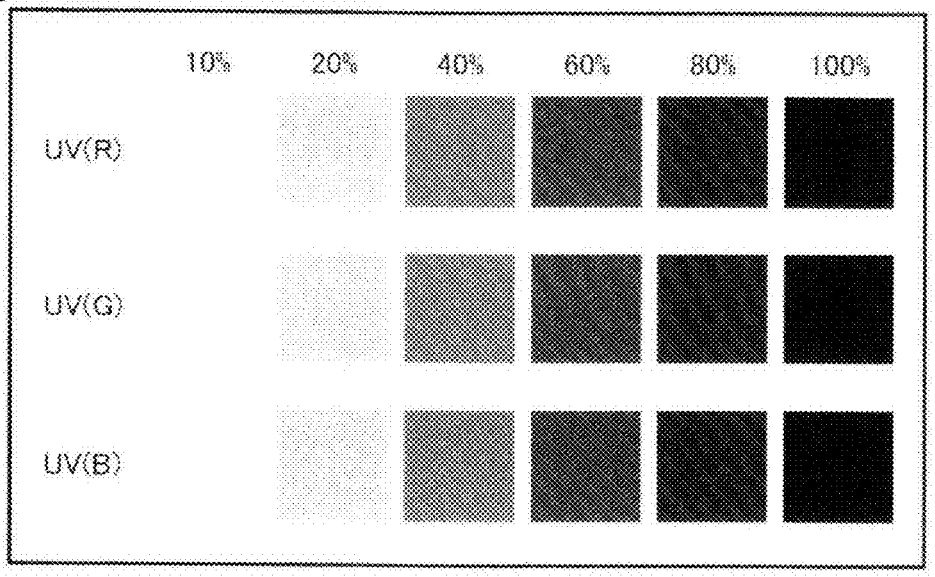
FIGS. 5A and 5B are diagrams illustrating sample images used to make print settings according to the first embodiment, FIG. 5A illustrating a first sample image and FIG. 5B illustrating a second sample image and a third sample image.
Figure 5B:
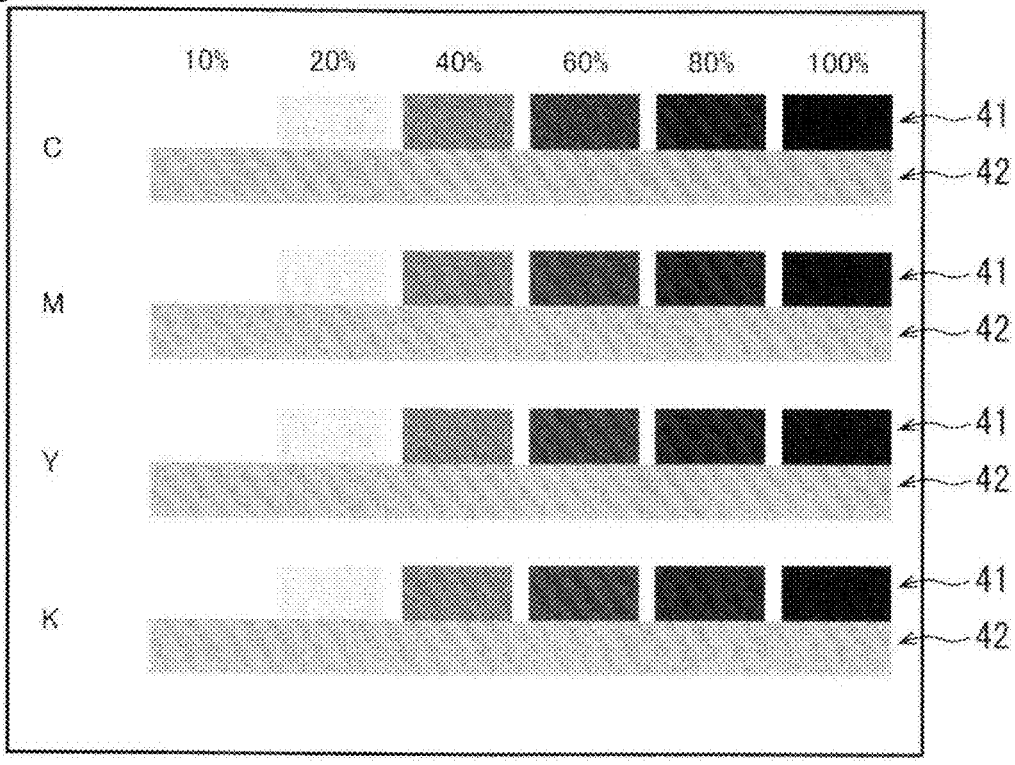

First, how a user sets printing conditions for image processing apparatus 101 is described with reference to FIGS. 1 and 2, as well as FIGS. 5A and 5B illustrating sample images used to make print settings according to the first embodiment.

The user issues a command to adjust UV-color print settings by operating operation panel 105 of image processing apparatus 101, and then sets optimal print conditions by the following three steps.

In Step 1, the user sets the density level of each UV toner. FIG. 5A illustrates the first sample image (a first image) which is a test pattern including images of each UV toner at different density levels. The test pattern (format) for this first sample image is stored in print color adjustment pattern storage 171 as first format information.

Image processing apparatus 101 has at least one development device filled with a UV toner, and in response to a command from print color adjustment part 170, the development device prints the first sample image shown in FIG. 5A on a medium. The sample image includes, for example, images of each of the red (R) UV toner, the green (G) UV toner, and the blue (B) UV toner at density levels of 10%, 20%, 40%, 60%, 80%, and 100% (when, for example, the density levels are represented by the percentages of pixels printed, which are equivalent to coverage rates).

Image processing apparatus 101 of the embodiment has three UV image formation units (development devices) 21R, 21G, and 21B filled with a red (R) UV toner, a green (G) UV toner and a blue (B) UV toner, respectively. Details of UV image formation units 21R, 21G, and 21B are given later.

Based on the first sample image thus printed out, the user decides the degrees of fluorescence and gloss for the UV toners according to a medium to be used and the intended use, determines the density level of the UV toners on the sheet, and sets the density levels.

Although the density levels of the UV toners are the same for all the RGB colors in the embodiment, different density levels may be set for the respective colors.

In Step 2, the user sets the fixation temperature. FIG. 5B illustrates the second sample image (a second image) in which image 42 formed by UV toners of RGB is superimposed on part of images 41 of each regular-color (colored) toner at different density levels, the regular-color toner being installed in image processing apparatus 101. The test pattern (format) for this second sample image is stored in print color adjustment pattern storage 171 as a second format information. In Step 2, each image of the UV toners in the second sample image is printed at the density level set in Step 1.

For example, the second sample image is printed using: a standard fixation temperature (standard temperature setting) which is set according to the thickness of the medium used by the user; a fixation temperature that makes a large gloss difference between a part printed with a regular-color (colored) toner and apart printed with a UV toner (a large gloss difference setting); and a fixation temperature that makes a small gloss difference between the part printed with a regular-color (colored) toner and the part printed with a UV toner (a small gloss difference setting). In sum, the second sample image is printed three times using the three fixation temperatures: the standard temperature setting, the large gloss difference setting, and the small gloss difference setting. Thus, three sheets of the second sample image are printed.

Figure 6A:
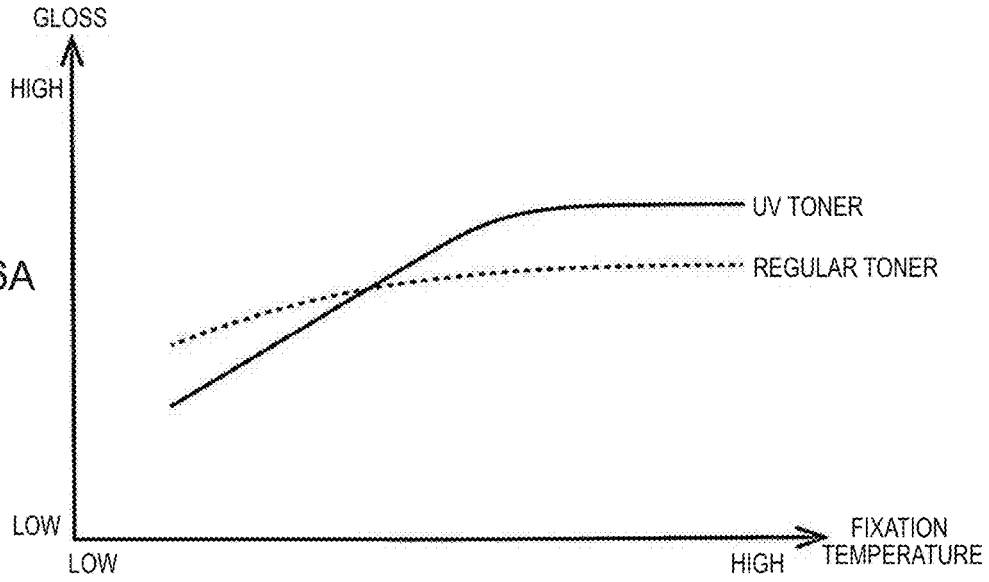
FIGS. 6A and 6B are diagrams illustrating the gloss level of a UV toner according to the first embodiment.

FIG. 6A is a graph illustrating the relation between a fixation temperature and gloss. As illustrated in FIG. 6A as an example, the fixation temperature does not greatly affect the gloss of a regular toner, but with a fixation temperature higher than a predetermined value, the gloss of a UV toner tends to exceed the gloss of a regular toner.

Based on the second sample images thus printed (the multiple second sample printed products), the user determines and sets the fixation temperature for the UV toners.

In Step 3, the user sets the number of fixation operations. In Step 3, the third sample image (a third image) shown in FIG. 5B is printed on multiple sheets using the UV-toner density level set in Step 1, the fixation temperature set in Step 2, and different numbers of fixation operations. The fixation operation is performed at least twice. The test pattern (format) for the third sample image is stored in print color adjustment pattern storage 171 as a third format information.

Although the fixation operation is performed at least twice herein, the upper limit for the number of fixation operations is to be set according to the status of the apparatus. In addition, although the second sample image (the second image) printed in Step 2 and the third sample image (the third image) printed in Step 3 have the same format in the embodiment, they may have different formats.

Figure 6B:
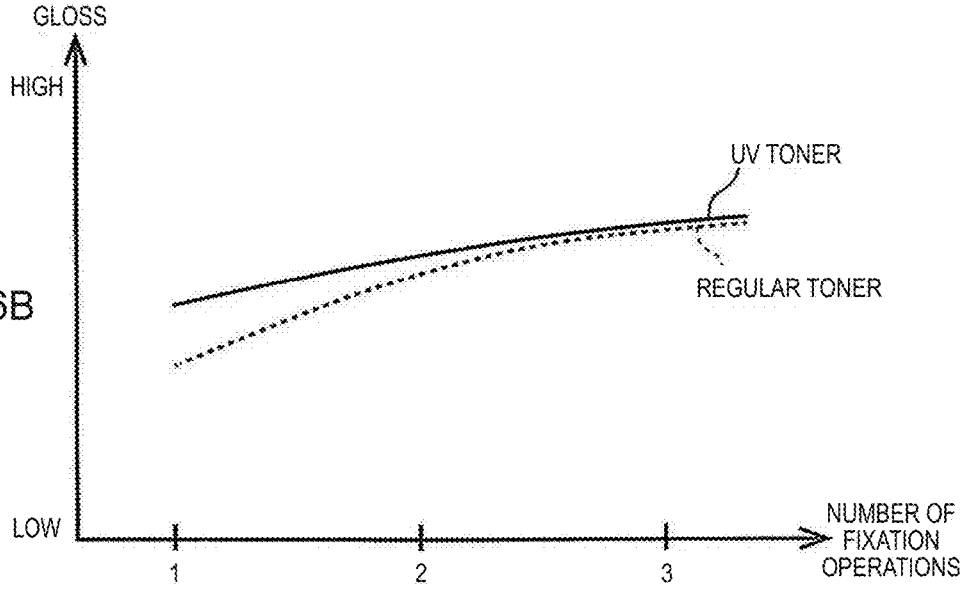

FIG. 6B is a graph illustrating the relation between the number of fixation operations and the gloss. As illustrated in FIG. 6B as an example, the gloss of a UV toner tends to increase gradually as the number of fixation operations increases, and the gloss of a regular toner tends to approach the gloss of a UV toner as the number of fixation operations increases.

Based on the third sample images thus printed (the multiple third sample printed products), the user determines and sets the number of fixation operations for the UV toners.

The UV toner density levels, the fixation temperature, and the number of fixation operations set in the foregoing three steps are stored in UV-color print parameter storage 172.

The user sets the UV toner density level, the fixation temperature, and the number of fixation operations using either operation panel 105 of image processing apparatus 101, or a web page displayed on a browser of a host computer connected to image processing apparatus 101 with a communications line, the web page being stored in storage 121 of image processing apparatus 101. Still alternatively, the foregoing settings may be made by running utility programs, installed in image processing apparatus 101, on the host computer.

Next, an additional description is given of the structure of printer device 168 of printer function part 114.

FIG. 3 is a concept diagram illustrating the structure of printer device 168.

As illustrated in FIG. 3, printer device 168 includes regular image formation units (regular toner image development units) 20Bk, 20Y, 20M, and 20C for black, yellow, magenta, and cyan, respectively, and UV image formation units (UV toner image development units) 21R, 21G, and 21B for red, green, and blue, respectively. Image formation units 20Bk, 20Y, 20M, 20C, 21R, 21G, and 21B are placed along media conveyance route Rt for sheet P from upstream to downstream.

Image formation units 20Bk, 20Y, 20M, and 20C form regular toner images using regular toners in black, yellow, magenta, and cyan, respectively. In other words, image formation units 20Bk, 20Y, 20M, and 20C are used to form, on sheet P, regular images visible to the naked eye. UV image formation units 21R, 21G, and 21B form. UV toner images using UV toners in red, green, and blue, respectively. In other words, UV image formation units 21R, 21G, and 21B are used to form images invisible to the naked eye (invisible images) on sheet P over the regular images. The invisible images are UV images in the embodiment. The UV images become visible when a predetermined kind of light, which is UV light in the embodiment, is applied to sheet P.

In FIG. 3, only image formation unit 20Bk is denoted by reference numerals for all its parts because image formation units 20Bk, 20Y, 20M, and 20C and UV image formation units 21R, 21G, and 21B have the same structure except for the colors of the toners therein, which are black toner 22Bk, yellow toner 22Y, magenta toner 22M, and cyan toner 22C as well as red UV toner 25R, green UV toner 25G, and blue UV toner 25B.

Image formation units 20Bk, 20Y, 20M, and 20C as well as UV image formation units 21R, 21G, and 21B each include toner cartridge 23 (a developer container) that contains a corresponding one of toners 22Bk, 22Y, 22M, and 22C of image formation units 20Bk, 20Y, 20M, and 20C as well as toners 25R, 25G, and 25B of UV image formation units 21R, 21G, and 21B.

Each of image formation units 20Bk, 20Y, 20M, and 20C as well as UV image formation units 21R, 21G, and 21B mainly includes rotatable photosensitive drum 31 (an image carrier), rotatable charging roller 32 (a charging device) that electrically charges the surface of photosensitive drum 31 evenly, LED head 33 (an exposure device) that irradiates the surface of photosensitive drum 31 with light based on print image data and thereby forms an electrostatic latent image (a latent image) thereon, rotatable development roller 34 (a developer carrier) that attaches a corresponding one of toners 22Bk, 22Y, 22M, and 22C and UV toners 25R, 25G, and 25B to photosensitive drum 31 to develop the electrostatic latent image and form a regular toner image (a regular developer image) or a UV toner image (a special developer image), and toner supply roller 35 (a developer supply member) that supplies developer roller 34 with a corresponding one of toners 22Bk, 22Y, 22M, and 22C and UV toners 25R, 25G, and 25B.

Belt unit u1 (a transfer unit) is placed below image formation units 20Bk, 20Y, 20M, and 20C as well as UV image formation units 21R, 21G, and 21B. Belt unit u1 mainly includes: rotatable drive roller R1 placed near UV image formation unit 21B; rotatable driven roller R2 placed near image formation unit 21Bk; transfer belt 38 that is looped and tensioned around drive roller R1 and driven roller R2 and travels in a direction indicated by the arrow in FIG. 3 as drive roller R1 rotates; and rotatable transfer rollers 37 (transfer members) facing, across transfer belt 38, respective photosensitive drums 31 of image formation units 20Bk, 20Y, 20M, and 20C as well as UV image formation units 21R, 21G, and 21B. Drive roller R1 is rotated by a motor (a drive part, not shown) and causes transfer belt 38 to travel and driven roller R2 to rotate.

As transfer belt 38 travels, sheet P is conveyed and fed to transfer units formed between transfer belt 38 and image formation units 20Bk, 20Y, 20M, and 20C and UV image formation units 21R, 21G, and 21B. At the transfer units, regular toner images and UV toner images formed on the surfaces of photosensitive drums 31 are transferred onto sheet P one on top of another.

Paired sheet feeder rollers 39 are placed upstream of belt unit u1 in terms of the conveyance direction of sheet P. Paired sheet feeder rollers 39 supply the transfer units with sheet P picked up from a sheet cassette (a media container, not shown).

Fixation unit 41 (a fusing device) is placed downstream of belt unit u1 in terms of the conveyance direction of sheet P. Fixation unit 41 includes rotatable heat roller 41*a* (a first fixation roller) and rotatable pressure roller 41*b* (a second fixation roller) in contact with heat roller 41*a*. Fixation unit 41 heats and presses the regular toner images and UV toner images transferred and superimposed on sheet P and thereby fixes (fuses) the images on sheet P. Thereby, regular images and UV images are formed on sheet P.

In addition, a discharger 43, which is formed of paired discharge rollers, and reconveyance unit 45 are placed downstream of fixation unit 41 in terms of the conveyance direction of sheet P. When sheet P is to be printed only on one side (one-sided printing), sheet P on which the regular images and UV images are formed is discharged by discharger 43 to the outside of printer device 168, i.e., the outside of the apparatus. To reconvey sheet P, i.e., as is the case herein, to subject sheet P to more than one fixation operation, sheet P on the surface of which the regular images and UV images are formed is, after passing through fixation unit 41, conveyed upstream of sheet feeder rollers 39 by reconveyance unit 45 to be fed to media conveyance route Rt again, so that the image formation units can superimpose regular images and UV images on sheet P, and/or fixation unit 41 can perform another fixation operation on sheet P.

Figure 7:
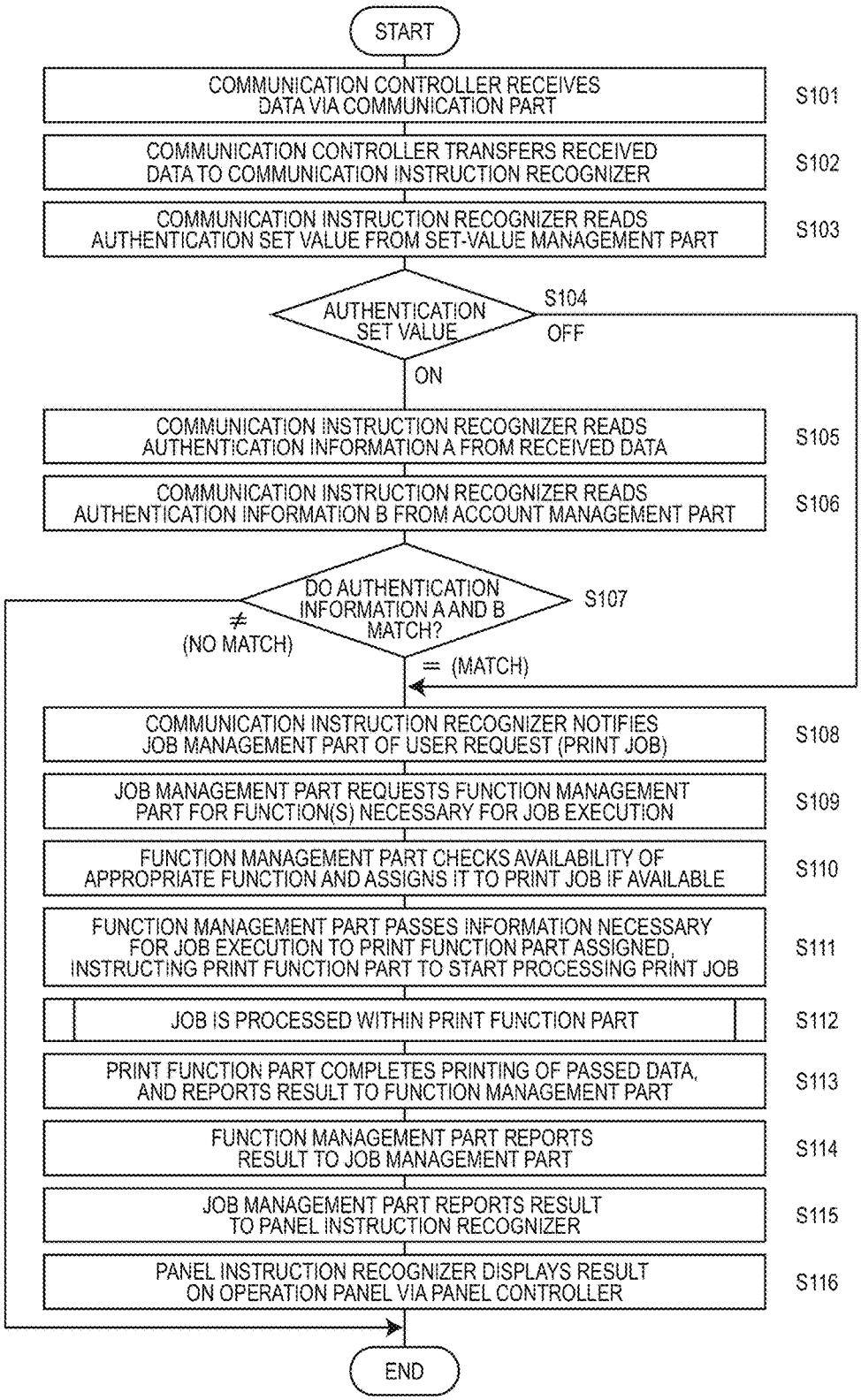
FIG. 7 is a flowchart illustrating print job processing according to the first embodiment.

Next, print job processing performed by image processing apparatus 101 is described with reference to FIG. 1 and a flowchart in FIG. 7 illustrating the print job processing according to the first embodiment. In the drawings and the following description, the letter S represents Step.

There are mainly two ways in which a user can input a job processing request to image processing apparatus 101. A first way is to input a job on an external device, such as a personal computer (PC), over a network or via a communications line such as a USB cable. Examples of jobs requested in such a way include regular printing requested from a PC using a printer driver, changing a set value from a PC using utility software, and monitoring the status of image processing apparatus 101 from a PC using a web page.

A second way is to input a job using operation panel 105. Examples of jobs requested using operation panel 105 include copying, scanning an original and emailing the scanned data, scanning an original and transferring the file to an external server, and sending a fax.

In an example described herein, a print job is instructed (requested) from an external device such as a PC.

S101: In image processing apparatus 101, communication controller 103 receives data from an external device, such as a PC, via communication part 102.

S102: Communication controller 103 transfers the received data to communication instruction recognizer 104. The data transferred is a print job, "print from PC", and is handled with a request identifier "PCPrint" in the following processing.

S103: Communication instruction recognizer 104 reads an authentication set value from set-value management part 119. An authentication set value is a set value that determines whether to perform user authentication. Since running cost for printer device 168 of image processing apparatus 101 is not very inexpensive nowadays in terms of consumables, image processing apparatus 101 may be set to restrict its users for cost reasons. Moreover, having information-transferring functions, such as sending an email or fax, and an original-copying function, image processing apparatus 101 may restrict its users in order to limit information leakage. Thus, the user authentication may be performed to restrict the users of image processing apparatus 101.

The authentication set value can be set by a user. Typically, only a user defined as an administrator has authority to change the authentication set value. The authority to change an authentication set value is, for example, added to an administrator account.

S104: Communication instruction recognizer 104 checks the authentication set value read in the previous step, and proceeds to S105 to perform authentication processing when determining that the authentication set value is "ON" indicating that authentication processing is to be performed, or proceeds to S108 without performing authentication processing when determining that the authentication set value is "OFF" indicating that authentication processing is not to be performed.

S105: Communication instruction recognizer 104 reads authentication information A from the received data. Authentication information A is information identifying a user inputting a job. Authentication information A, which may be any of various types of authentication information as described earlier, is "user name" and "password" in the embodiment. The "user name" and "password" are handled as a pair, with "user name" being a public value and "password" being a non-public value. Identical values cannot be used for "user names" because that would result in duplicate registration, but identical values may be used for "passwords".

S106: Communication instruction recognizer 104 reads authentication information B, which is preregistered in account management part 108, from account management part 108. Since the authentication processing is performed by a comparison of authentication information entered upon input of a job with authentication information registered in advance, authentication information on authorized users needs to be registered in advance. In the embodiment, the preregistered authentication information is called authentication information B. The types of authentication information B are the same as those of authentication information A, but different from authentication information A in nature. If authentication information A is an exam sheet with answers written by a student, authentication information B is an answer sheet with correct answers.

S107: Communication instruction recognizer 104 determines whether authentication information A and authentication information B match by comparing them against each other. Communication instruction recognizer 104 proceeds to S108 when determining that authentication information A and authentication information B match, and ends this print job processing when they do not match.

When determining that authentication information A and authentication information B match, i.e., when the user is successfully authenticated, communication instruction recognizer 104 acknowledges that the user who has inputted the job is a registered user, and proceeds to S108 to execute the job inputted. On the other hand, when determining that authentication information A and authentication information B do not match, i.e., when the user is not authenticated, communication instruction recognizer 104 does not acknowledge that the user who has inputted the job is a registered user, and ends the print job processing to reject the job inputted.

S108: Communication instruction recognizer 104 notifies job management part 109 of the inputted job as a user request (a print job). The user request is referred to as "print from PC (PCPrint)" in the embodiment.

S109: Job management part 109 requests, from function management part 110, a function necessary to execute the user request. Job management part 109 recognizes the user request, "print from PC", by an internal representation "PCPrint" and reads, from internal information, information indicating that a function necessary for this request is "print processing". Job management part 109 manages this request by monitoring how the request is processed in image processing apparatus 101 and when this request is completed therein. Job management part 109 makes an inquiry at function management part 110 about a function necessary to execute the "print from PC" job being managed by job management part 109.

S110: Function management part 110 checks the availability of the required function, and assigns the function, if available, to the job.

In the embodiment, function management part 110 assigns printer function part 114 to the "print from PC" job. For example, if printer function part 114 is in use, function management part 110 assigns printer function part 114 to the "print from PC" job as soon as printer function part 114 ends its processing.

S111: Function management part 110 passes information necessary for execution of the job to printer function part 114 assigned, and instructs printer function part 114 to start processing the job. Data to be passed to printer function part 114 by function management part 110 is passed to function management part 110 via communication part 102, communication controller 103, communication instruction recognizer 104, and job management part 109.

S112: Printer function part 114 performs the processing for printing the passed data. Details for this print processing are given later.

S113: When completing the processing for printing the passed data, printer function part 114 reports a result of the processing to function management part 110.

S114: Function management part 110 reports the reported result to job management part 109.

S115: Job management part 109 reports the reported result to panel instruction recognizer 107.

S116: Panel instruction recognizer 107 displays the reported result on operation panel 105 via panel controller 106. With this, the print job processing ends.

Figure 8:
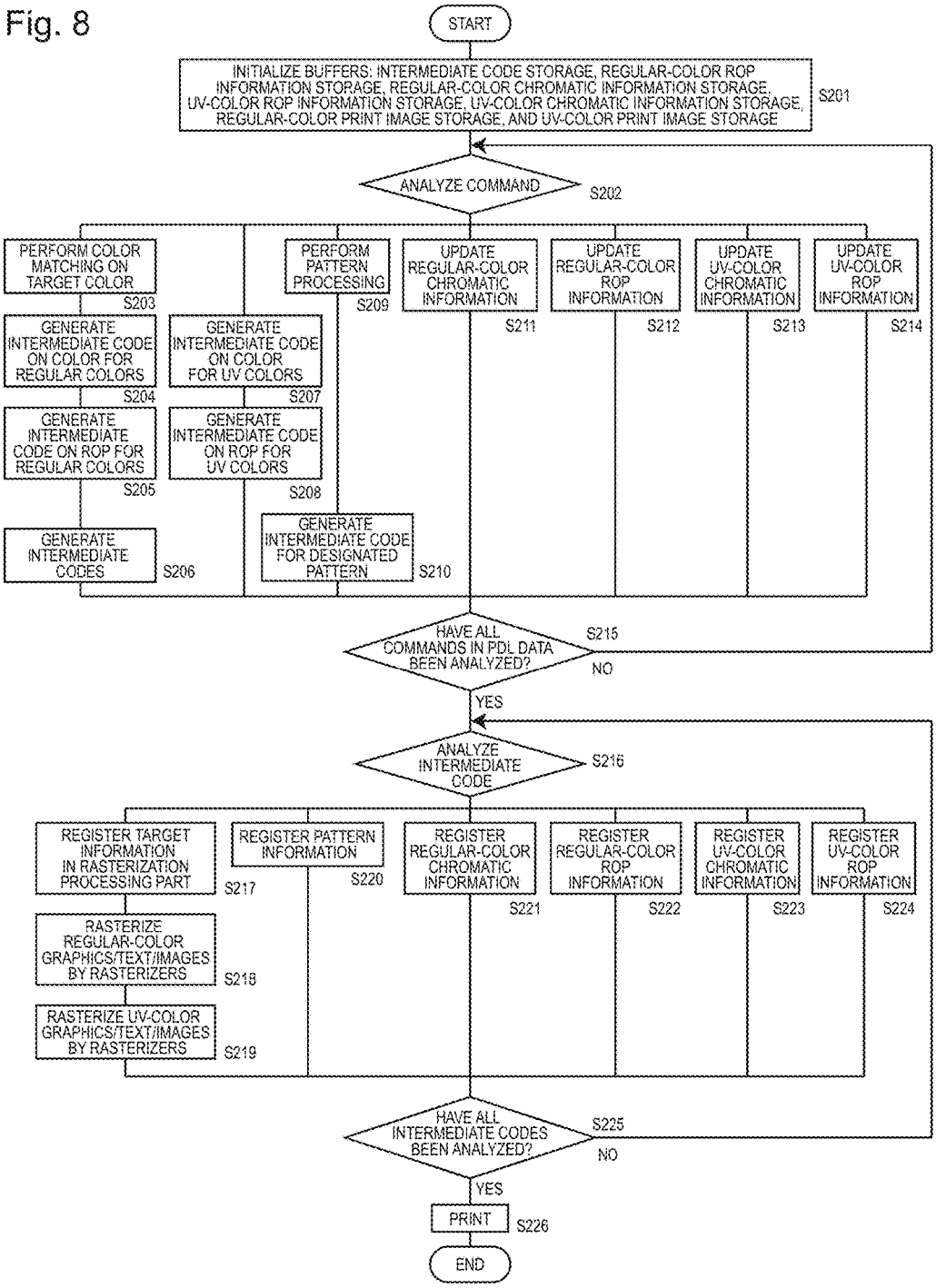
FIG. 8 is a flowchart illustrating print processing according to the first embodiment.

Next, the print processing performed by printer function part 114 is described with reference to FIG. 2 and the flowchart in FIG. 8 which illustrates the print job processing according to the first embodiment. In the drawings and the following description, the letter S represents Step.

S201: Printer function part 114 initializes the following buffers: intermediate-code storage 161, regular-color ROP information storage 162, regular-color chromatic information storage 163, UV-color ROP information storage 164, UV-color chromatic information storage 165, regular-color print image storage 166, and UV-color print image storage 167.

Specifically, printer function part 114 sequentially initializes the above buffers, namely, intermediate-code storage 161 which is a buffer management part for allowing PDL data analyzer 151 and rasterization processing part 153 to share information, regular-color print image storage 166 and UV-color print image storage 167 which are buffer management parts for allowing rasterization processing part 153 and printer device 168 to share information, regular-color ROP information storage 162 and regular-color chromatic information storage 163 used as workspace memory for regular-color graphics rasterizer 155, regular-color text rasterizer 156, and regular-color image rasterizer 157, and UV-color ROP information storage 164 and UV-color chromatic information storage 165 used as workspace memory for UV-color graphics rasterizer 158, UV-color text rasterizer 159, and UV-color image rasterizer 160.

S202: PDL data analyzer 151 analyzes PDL data received from PDL data receiver 150, and performs appropriate processing according to commands in the PDL data.

PDL data analyzer 151 distinguishes the following types of commands from one another: commands for printing graphics, text, and image in regular-colors (i.e., colors in visible light spectrum which are represented by cyan (C), magenta (M), yellow (Y), and black (K)), commands for printing graphics, text, and image in UV colors, commands for printing patterns and the like, and commands for changing table data (chromatic information and ROP information) used in printing.

PDL data analyzer 151 proceeds to S203 when the PDL data commands printing of graphics, text, and image in regular-colors, proceeds to S207 when the PDL data commands printing of graphics, text, and image in UV colors, proceeds to S209 when the PDL data commands pattern processing, proceeds to S211 when the PDL data commands update of regular-color chromatic information, proceeds to S212 when the PDL data commands update of regular-color ROP information, proceeds to S213 when the PDL data commands update of UV-color chromatic information, or proceeds to S214 when the PDL data commands update of UV-color ROP information.

Through the PDL data analysis, PDL data analyzer 151 discards all data other than PDL data (including data to be printed).

S203: For a command for printing with a regular color, which requires color matching, PDL data analyzer 151 asks color matching processing part 152 to perform color matching processing. Color matching processing is performed also for a UV color when the device or toner is not of a typical type. However, a UV color is not subjected to color space conversion into yellow (Y), magenta (M), cyan (C), and black (K).

S204: PDL data analyzer 151 interprets the PDL commands and generates, for each of graphics, text, and image, intermediate code (display list) on color for regular colors. PDL data analyzer 151 stores the generated intermediate code in intermediate-code storage 161.

S205: PDL data analyzer 151 interprets the PDL commands and generates, for each of graphics, text, and image, intermediate code (display list) on ROP for regular colors. PDL data analyzer 151 stores the generated intermediate code in intermediate-code storage 161.

S206: PDL data analyzer 151 generates intermediate code representing graphics, text, and image while considering chromatic information stored in regular-color chromatic information storage 163 and ROP information stored in regular-color ROP information storage 162, and then proceeds to S215. PDL data analyzer 151 stores the generated intermediate code in intermediate-code storage 161.

S207: PDL data analyzer 151 interprets the PDL commands and generates, for each of graphics, text, and image, intermediate code (display list) on color for UV colors. PDL data analyzer 151 stores the generated intermediate code in intermediate-code storage 161.

S208: PDL data analyzer 151 interprets the PDL commands and generates, for each of graphics, text, and image, intermediate code (display list) on ROP for UV colors. PDL data analyzer 151 stores the generated intermediate code in intermediate-code storage 161, and proceeds to S206.

S209: PDL data analyzer 151 performs pattern processing for specifying designated pattern data (sample data).

S210: PDL data analyzer 151 generates intermediate code according to the designated pattern data, and proceeds to S215. PDL data analyzer 151 stores the generated intermediate code in intermediate-code storage 161.

S211: PDL data analyzer 151 updates the chromatic information stored in regular-color chromatic information storage 163, and proceeds to S215.

S212: PDL data analyzer 151 updates the ROP information stored in regular-color ROP information storage 162, and proceeds to S215.

S213: PDL data analyzer 151 updates the chromatic information stored in UV-color chromatic information storage 165, and proceeds to S215.

S214: PDL data analyzer 151 updates the ROP information stored in UV-color ROP information storage 164, and proceeds to S215.

S215: PDL data analyzer 151 determines whether analysis of the PDL data is completed, and proceeds to S216 when the analysis is completed, or proceeds to S202 to continue the PDL data analysis when the analysis is not completed.

After the foregoing PDL data analysis processing, intermediate-code storage 161 has intermediate data stored therein as analysis results of the PDL data.

S216: Using intermediate-code distinguisher 154, rasterization processing part 153 sequentially analyzes the intermediate code read from intermediate-code storage 161, and according to its content, assigns each intermediate code to an appropriate processing.

Rasterization processing part 153 proceeds to S217 when the intermediate code is a command to rasterize graphics, text, or image in regular colors or a command to rasterize graphics, text, or image in UV colors, proceeds to S220 when the intermediate code is a command to register pattern information, proceeds to S221 when the intermediate code is a command to register regular-color chromatic information, proceeds to S222 when the intermediate code is a command to register regular-color ROP information, proceeds to S223 when the intermediate code is a command to register UV-color chromatic information, or proceeds to S224 when the intermediate code is a command to register UV-color ROP information.

Rasterization processing part 153 distinguishes rasterization commands for rasterizing graphics, text, and image in regular colors, and graphics, text, and image in UV colors, as well as patterns and the like, and commands for registering table data (chromatic information and ROP information) used in printing.

Rasterization processing part 153 asks regular-color graphics rasterizer 155 for processing on the command to rasterize graphics in regular colors, asks regular-color text rasterizer 156 for processing on the command to rasterize text in regular colors, and asks regular-color image rasterizer 157 for processing on the command to rasterize an image in regular colors.

Similarly, rasterization processing part 153 asks UV-color graphics rasterizer 158 for processing on the command to rasterize graphics in UV colors, asks UV-color text rasterizer 159 for processing on the command to rasterize text in UV colors, and asks UV-color image rasterizer 160 for processing on the command to rasterize an image in UV colors.

In addition, for commands to register table data used in rasterization processing, rasterization processing part 153 asks regular-color graphics rasterizer 155 for processing when the command targets graphics in regular colors and asks regular-color text rasterizer 156 for processing when the command targets text in regular colors. Similarly, rasterization processing part 153 asks UV-color graphics rasterizer 158 for processing when the command targets graphics in UV colors and asks UV-color text rasterizer 159 for processing when the command targets text in UV colors.

S217: Intermediate-code distinguisher 154 distinguishes the intermediate codes read from intermediate-code storage 161, for chromatic information and graphics, text, or image data, and passes the data thus distinguished to rasterization processing part 153.

S218: Upon receipt of graphics, text, or image data in regular colors, rasterization processing part 153 asks regular-color graphics rasterizer 155 for processing when graphics rasterization is commanded, asks regular-color text rasterizer 156 for processing when text rasterization is commanded, and asks regular-color image rasterizer 157 for processing when image rasterization is commanded. Raster data thus generated by the rasterization command is stored in regular-color print image storage 166.

S219: Upon receipt of graphics, text, or image data in UV colors, rasterization processing part 153 asks UV-color graphics rasterizer 158 for processing when graphics rasterization is commanded, asks UV-color text rasterizer 159 for processing when text rasterization is commanded, and asks UV-color image rasterizer 160 for processing when image rasterization is commanded. Rasterization processing part 153 then proceeds to S225. Raster data thus generated by the rasterization command is stored in UV-color print image storage 167.

S220: When a rasterization target read from the intermediate code is a pattern, intermediate-code distinguisher 154 registers information on the pattern in rasterization processing part 153, and proceeds to S225. Chromatic information, ROP information, and a rasterization target are typically written as a set in intermediate code, but when they are written independently, the above processing is unnecessary.

S221: When a rasterization target read from the intermediate code is regular-color chromatic information, intermediate-code distinguisher 154 registers the regular-color chromatic information in rasterization processing part 153, and proceeds to S225.

S222: When a rasterization target read from the intermediate code is regular-color ROP information, intermediate-code distinguisher 154 registers the regular-color ROP information in rasterization processing part 153, and proceeds to S225.

S223: When a rasterization target read from the intermediate code is UV-color chromatic information, intermediate-code distinguisher 154 registers the UV-color chromatic information in rasterization processing part 153, and proceeds to S225.

S224: When a rasterization target read from the intermediate code is UV-color ROP information, intermediate-code distinguisher 154 registers the UV-color ROP information in rasterization processing part 153, and proceeds to S225.

S225: Intermediate-code distinguisher 154 determines whether all the intermediate codes have been analyzed, and proceeds to S226 when determining that all the intermediate codes have been analyzed, or proceeds back to S216 to continue the intermediate code analysis when determining that not all the intermediate codes have been analyzed.

S226: Printer function part 114 causes printer device 168 to perform printing of print image data stored in regular-color print image storage 166 and UV-color print image storage 167 by using the printing density level for each UV color toner, the fixation temperature, and the number of fixation operations stored in UV-color print parameter storage 172. With this, the print processing by print function part 114 ends.

As in the foregoing, the embodiment performs printing based on the print density levels for UV toners, fixation temperature, and the number of fixation operations which are set by a user, and thereby can produce a print result as desired by the user.

By thus being allowed to set the print density levels for UV toners, fixation temperature, and the number of fixation operations, the user can be provided with a printing service suited for the intended use of the print result, such as adding a security feature or a design feature.

Further, such an effective print service is achieved with a smaller amount of UV toners being consumed.

The print density level may be set commonly or individually to the UV color toners.

As described above, in the first embodiment, image processing apparatus 101 performs printing using UV toners and regular toners based on the print density levels for UV toners, fixation temperature, and number of fixation operations which are set by a user. Thus, in printing using a transparent toner, the first embodiment advantageously produces a print result as desired by the user.

In other words, the first embodiment advantageously provides a print service suited for the use of the print result intended by a user because the user can add a security feature, a design feature, or the like to the print result.

As another advantageous effect, such an effective print service can be provided with less amount of transparent toner being consumed.

[Second Embodiment]

To check a UV print result on which UV toners are printed over regular-color toners, ultraviolet light needs to be applied to the UV print result. However, the intensity or wavelength of the ultraviolet light differs depending on the user's environment. Thus, it is difficult to obtain a UV printing result as desired by the user.

In view of the above problem, in a second embodiment, to perform UV printing best suited for each user's environment, a first sample image (a test pattern) is printed by superimposing UV toners of various density levels over regular-color toners, so that the user can select the density levels of the UV toners best suited for their environment.

The second embodiment has the same configuration as the foregoing first embodiment; hence, the same reference numerals as those used in the first embodiment are used in the second embodiment to avoid repetitive description.

Operation of the second embodiment is described below.

Figure 9:
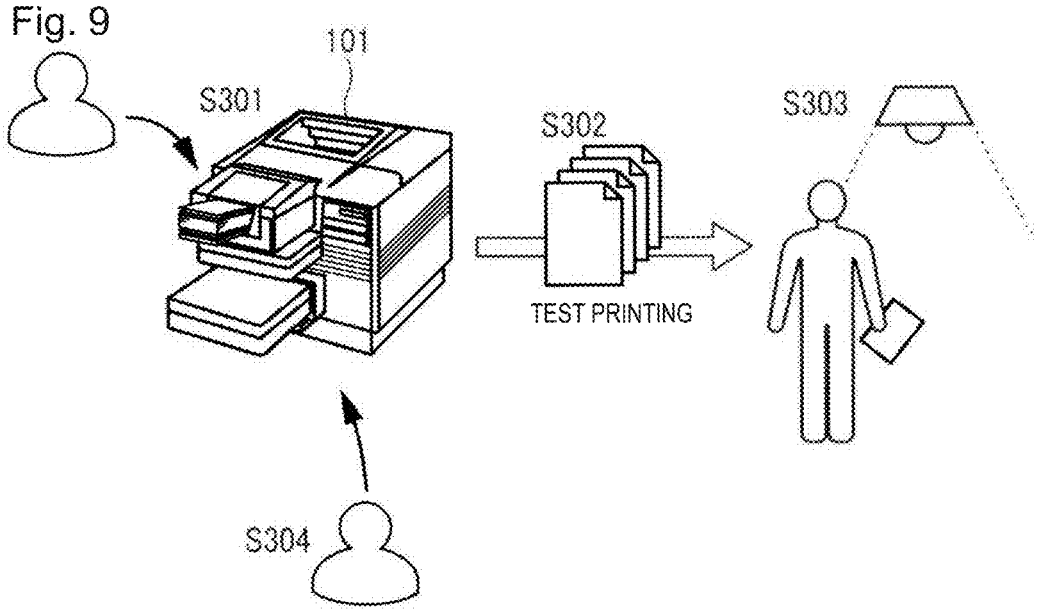
FIG. 9 is a diagram illustrating how a user makes print settings according to a second embodiment.

How a user makes printing settings for image processing apparatus 101 is described with reference to FIGS. 1 and 2 as well as FIG. 9 illustrating printing settings according to the second embodiment.

S301: A user issues a command to print the first sample image (a test pattern) for UV density determination to image processing apparatus 101. The user issues the command to print the test pattern by using operation panel 105 of image processing apparatus 101 or a web page displayed on a browser of a host computer connected to image processing apparatus 101 via a communications line, the web page being stored in storage 121 of image processing apparatus 101. The user may alternatively issue the command by running utility programs, installed in image processing apparatus 101, on the host computer.

S302: Upon receipt of the command to print the test pattern for UV density determination, image processing apparatus 101 prints the test pattern for UV density determination (a first image).

S303: The user holds a printed product on which the test pattern has been printed by image processing apparatus 101, moves to an environment for observing the printed product, examines the test pattern under that environment, and determines the suitable density levels for the UV toners.

When a user submits a print job that uses UV toners, it is often likely that the user observes the print result at a limited location. In such a case, the intensity of ordinary light, the intensity of ultraviolet (UV) light, the media to be used, and the like are determined in advance. Thus, the user determines and sets the density levels of the UV toners so that the UV printing can result in a print result best suited for the predetermined environment.

The location where the user observes a print result is a place where a printing result is most likely to be observed.

Figure 10:
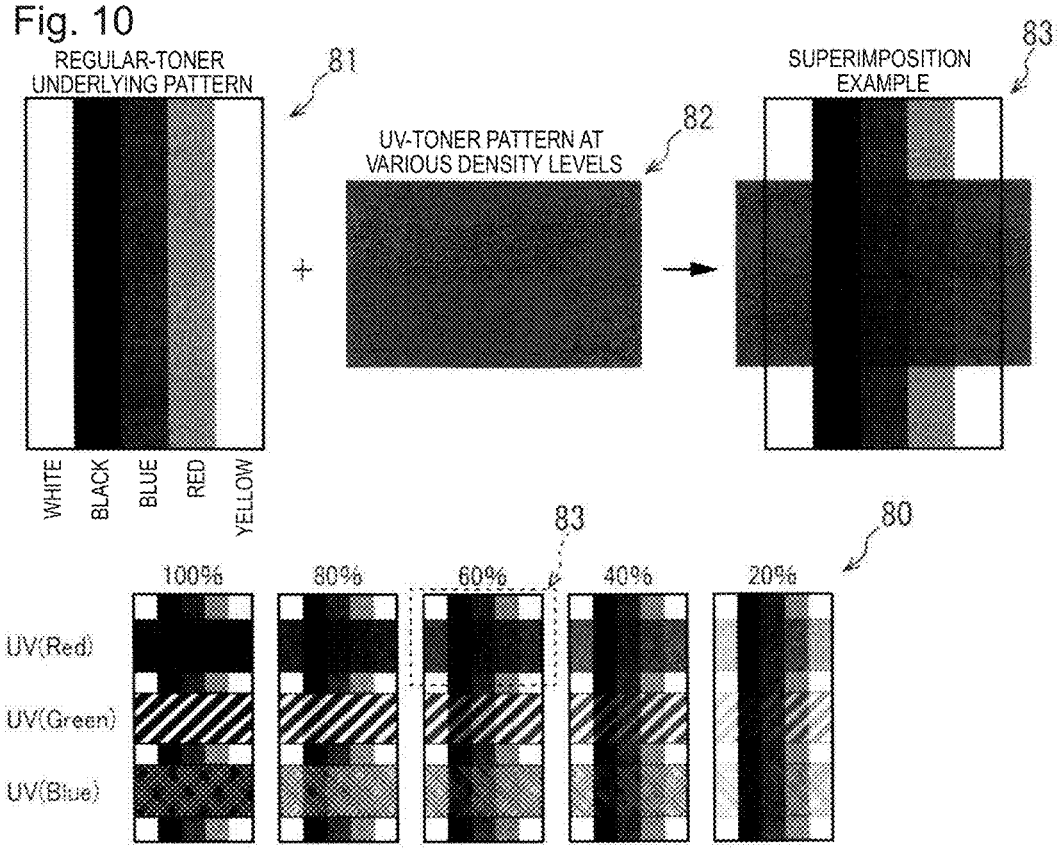
FIG. 10 is a diagram illustrating a first sample image (a test pattern) used to make print settings according to the second embodiment.

The test pattern (the first image) printed by image processing apparatus 101 is described with reference to FIG. 10 illustrating a test pattern for print settings according to the second embodiment.

Test pattern 80 of the second embodiment includes patterns 83 each formed by superimposing patterns 82 over regular-toner underlying pattern 81 (including images of regular toners in different colors). Patterns 83 superimposed on each underlying pattern 81 are a UV red toner image, a UV green toner image, and a UV blue toner image having different density levels (e.g., 100%, 80%, 60%, 40%, and 20%) for each underlying pattern 81 (i.e., patterns 83 are images formed using special toners of varied density levels). In sum, test pattern 80 of the second embodiment includes five patterns 83 at different UV toner density levels, each pattern 83 being generated by superimposition of three patterns 82, for the respective three UV toner colors, on underlying pattern 81.

Each regular-toner underlying pattern 81 is formed using regular toners and may include five colors arranged in a pattern, e.g., white, black, blue, red, and yellow. Regular-toner underlying pattern 81 may include a color other than the foregoing five colors, namely, white, black, blue, red, and yellow.

UV-toner patterns 82 superposed on each regular-toner underlying pattern 81 are formed using a UV red toner, a UV green toner, and a UV blue toner, at a density level (100%, 80%, 60%, 40%, or 20%) different for each pattern 81.

By examining test pattern 80, the user can determine the density level of the UV toners relative to the underlying regular toners so that a desired print result can be obtained at a location where the printed product (print result) is to be observed.

The density levels of the UV toners printed in the respective colors are not necessarily set every 20%, but may be set every 10%.

Although the underlying pattern is formed using regular toners and the overlying pattern is formed using UV toners in the second embodiment, the invention is not limited to this. The underlying pattern may be formed using UV toners, and the overlying pattern may be formed using regular toners, instead. This allows a user to determine the density levels of the UV toners for a case where the UV toners underlie and the regular toners overlie.

S304: In image processing apparatus 101, the user sets the suitable UV-toner density levels determined in the previous step for the respective colors of the UV toners. The user sets the UV-toner density levels using operation panel 105 of image processing apparatus 101 or a web page displayed on a browser of a host computer connected to image processing apparatus 101 via a communications line, the web page being stored in storage 121 of image processing apparatus 101. The user may alternatively set the UV-toner density levels by running utility programs, installed in image processing apparatus 101, on the host computer.

The UV-toner density levels set for the respective colors of the UV toners are stored in UV-color print parameter storage 172.

In the foregoing second embodiment, a test pattern is printed by superimposing UV toners of density levels, which are varied stepwise, on underlying regular toners of the respective colors. This allows the user to select UV toner density levels best suited for the user's environment.

As described, in addition to the advantageous effect produced by the first embodiment, the second embodiment advantageously allows a user to select UV-toner density levels best suited for the user's environment.

Although the image processing apparatus is a multi-function peripheral in the first embodiment and the second embodiment, the invention is not limited to a multi-function peripheral. The image processing apparatus may be a printer, a facsimile, or the like that uses a transparent toner.

The invention claimed is:

1. An image processing apparatus comprising:

a printer device including an image formation unit that form, on a medium, a toner image including a regular toner and a special toner, and a fixation unit that performs a predetermined number of fixation operations of fusing the toner image on the medium; and an adjustment part that causes the printer device to print a first sample image using the special toner at various density levels, and receives a user input of a first setting for the density level of the special toner, wherein:

the printer device forms the toner image on the medium based on the first setting received, and fixes the toner image on the medium; and the printer device prints the first sample image by a superimposition of first pattern images each formed using the special toner at different density levels and second pattern images each formed using a plurality of the regular toners in different colors, wherein the first sample image is formed the first pattern images on or under the second pattern images.

2. The image processing apparatus according to claim 1, wherein the adjustment part causes the printer device to print two or more second sample images using the density level of the first setting and using respectively different fixation temperatures for the second sample images, and thereby acquires printed products on which the second sample images are respectively printed, the adjustment part receives a user input of a second setting for a fixation temperature, and the printer device forms the toner image on the medium based on the first setting received, and fixes the toner image on the medium based on the second setting received.

3. The image processing apparatus according to claim 2, wherein the adjustment part causes the printer device to print two or more third sample images using the density level of the first setting and the fixation temperature of the second setting by performing respectively different numbers of fixation operations for the third sample images, and thereby acquires printed products on which the third sample images are respectively formed, the adjustment part receives a user input of a third setting for the number of fixation operations, and the printer device forms the toner image on the medium based on the first setting received, and fixes the toner image on the medium based on the second setting received and the third setting received.

4. The image processing apparatus according to claim 3, further comprising a settings information storage that stores the density level as the first setting, the fixation temperature as the second setting, and the number of fixation operations as the third setting that are set by the adjustment part, wherein the printer device performs a printing based on the density level, the fixation temperature, and the number of fixation operations that are set and stored in the settings information storage.

5. The image processing apparatus according to claim 3, further comprising a format information storage that stores a first format information indicating a format for the first sample image, a second format information indicating a format for the second sample image, and a third format information indicating a format for the third sample image, wherein the printer device prints the first sample image, the second sample image, and the third sample image based respectively on the first format information, the second format information, and the third format information that are stored in the format information storage.

6. The image processing apparatus according to claim 1, wherein each of the second pattern images includes white, black, blue, red, and yellow images.

7. The image processing apparatus according to claim 1, wherein the special toner fluoresces under ultraviolet light and is transparent under visible light.

8. The image processing apparatus according to claim 1, wherein the density level is set for each color of the special toner, and the printer device forms the toner image on the medium with the special toner formed at a density level set for each color.

9. The image processing apparatus according to claim 1, wherein the image formation unit includes a first image formation part that forms a regular toner image on the medium using the regular toner and a second image formation part that forms a special toner image on the medium using the special toner, and the toner image is formed by a superimposition of the regular toner image and the special toner image.

10. An image processing apparatus comprising a printer device including an image formation unit that forms, on a medium, a toner image including a regular toner and a special toner, and a fixation unit that performs a predetermined number of fixation operations of fusing the toner image on the medium; and an adjustment part that causes the printer device to print two or more same sample images at respectively different fixation temperatures, thereby acquires printed products on which the sample images are respectively printed, and receives a user input of a setting for a fixation temperature, wherein the printer device performs an image formation operation of forming the toner image on the medium, and performs a fixation operation of fusing the toner image on the medium based on the setting received, and the predetermined number of fixation operations is user settable, and the fixation unit fixes the toner image on the medium based on a setting of the predetermined number of fixation operations.

11. The image processing apparatus according to claim 10, wherein the image formation unit includes a first image formation part that forms a regular toner image on the medium using the regular toner and a second image formation part that forms a special toner image on the medium using the special toner, and the toner image is formed by a superimposition of the regular toner image and the special toner image.

12. An image processing adjustment method performed by an image processing apparatus that forms, on a medium, a toner image containing a regular toner and a special toner and performs a predetermined number of fixation operations of fusing the toner image on the medium using a predetermined fixation temperature, the method comprising:

printing a first sample image using the special toner at various density levels;

printing second sample images using respectively different fixation temperatures;

receiving a user input of a first setting for a density level of the special toner;

receiving a user input of a second setting for the fixation operation;

forming, on a medium, a toner image containing the special toner based on the first setting and fixing the toner image on the medium based on the second setting; and printing the first sample image is formed first pattern images on or under second pattern images, wherein the first sample image is formed by a superimposition of the first pattern images each formed using the special toner at different density levels and the second pattern images each formed using a plurality of the regular toners in different colors.

13. The image processing adjustment method according to claim 12, wherein each of the pattern images formed using the regular toner in the plurality of colors includes white, black, blue, red, and yellow images.

* * * * *